United States Patent [19]

Nemeth

[11] Patent Number: 4,973,048

[45] Date of Patent: Nov. 27, 1990

[54] ATHLETIC COMPETITION JAVELIN WITH ROUGHENED SURFACES

[76] Inventor: Miklós Nemeth, Szépjuházné út Bagolyv, 1021 Budapest, Hungary

[21] Appl. No.: 269,666

[22] PCT Filed: Aug. 12, 1987

[86] PCT No.: PCT/HU87/00034

§ 371 Date: Jun. 3, 1988

§ 102(e) Date: Jun. 3, 1988

[87] PCT Pub. No.: WO88/01187

PCT Pub. Date: Feb. 25, 1988

[30] Foreign Application Priority Data

Aug. 12, 1986 [HU] Hungary ..... 3532/86

[51] Int. Cl.[5] ..... A63B 65/00

[52] U.S. Cl. ..... 272/106

[58] Field of Search ..... 272/106, 104; 273/416, 273/420, 418

[56] References Cited

U.S. PATENT DOCUMENTS 4,333,643 6/1982 Saffire ..... 272/106

4,337,940 5/1982 Soong ..... 272/106

FOREIGN PATENT DOCUMENTS 0278644 10/1927 United Kingdom ..... 272/106

OTHER PUBLICATIONS

"The Dynamics of Javelin Throw", A.S.M.E., Soong, Journal of Applied Mechanics, 1975, p. 1–6.

*Primary Examiner*—Stephen R. Crow

*Attorney, Agent, or Firm*—Herbert Dubno

[57] ABSTRACT

A flight distance of a competition javelin is improved and the tendency of the javelin to strike the ground leading point first by providing the javelin body so that it conforms to the competitive standards and by providing the body with surface roughening with a density of roughening points of at least 30 points/cm$^2$ with a point height of substantially 0.1 to 0.5 mm. For men's competition the roughened surface is provided over a length of the body extending substantially 180 cm rearwardly of the grip. For women's competition, the entire surface of the javelin can be so roughened or the roughening can be provided only over a length of the body corresponding to the last 40 to 70 cm rearwardly of the grip.

16 Claims, 1 Drawing Sheet

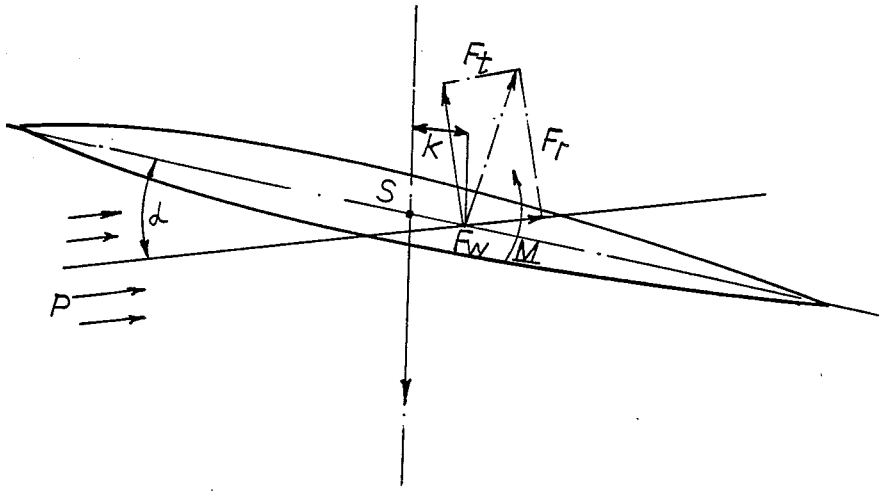
FIG.1
FIG.2
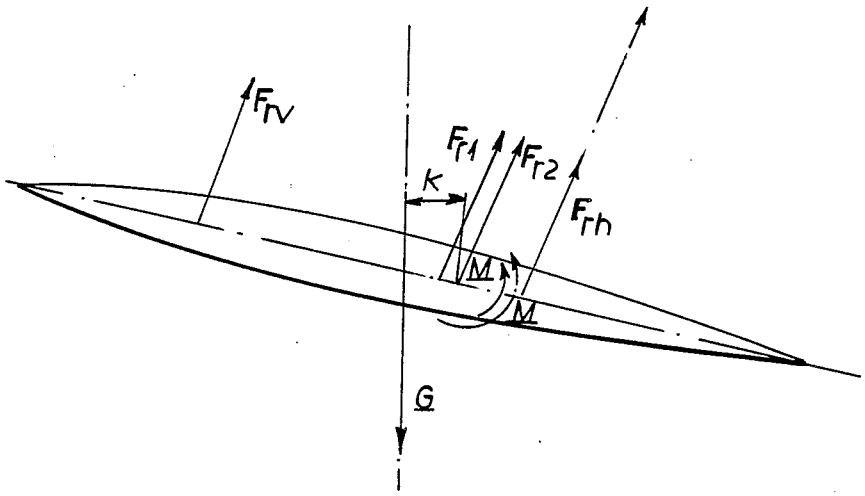

ATHLETIC COMPETITION JAVELIN WITH ROUGHENED SURFACES

FIELD OF THE INVENTION

My present invention relates to a javelin for sporting applications, having improved flight characteristics.

BACKGROUND OF THE INVENTION

In the course of its several thousand year old history, the javelin as a weapon and later as a sports article was always made with the assumption that its streamlined shape and smoothest possible surface were essential for the best flight. This belief carried into the 20th century with the development of javelin as a sports article. One manufacturer, endeavoring to achieve the utmost in smoothness of surface, went so far as to plate the entire surface of a steel javelin with chromium. However this did not have the desired effect. This failure pointed out that other concepts also had to be taken into consideration in order to achieve the best flight properties.

Nevertheless, javelins, whose dimensions are regulated by the strict rules of the International Athletic Federation, were developed with superior airworthiness and sailing characteristics. After javelins had been thrown in excess of 100 meters, the development of this kind of sport stimulated the international federation to make changes in the regulations relating to men's javelin, and changes were also intended in women's javelin, too. The aim of the introduced changes is to reduce the flight distance and to change the trajectory of the javelin in such a way that it should always land with its tip first sticking into the ground, which results in reducing danger and eliminates debates on the appropriateness of the throw. As a matter of fact, the modifications were made with good intentions, but altered the flight characteristics of men's javelin that had outstanding airworthiness before. The javelin that is in accordance with the new regulations causes the athlete to make a throw that is, on average, 8–10 meters shorter than before. Therefore both the manufacturers and athletic competitors sought to construct a new kind of javelin that has similar properties and efficiency to that of the old one but has respect for the new rules and remains within their limitations. However, the possibility of developing an improved javelin faces firm restrictions laid down by the regulations. Men's javelin may have a weight of 800 grams, a length of 260 centimeters and a maximum diameter of 30 millimeters, while women's javelin has a required weight of 600 grams, a length of 220 centimeters and a maximum diameter of 25 millimeters. Moreover, there are rules governing the javelin's shape, center of gravity and also the location of the so-called cord that serves as a grip of the javelin. Thus, for instance, the center of gravity of men's javelin must be located under the grip at a maximum of 106 centimeters behind the front tip, while the thickness of the javelin may reach not more than 27 millimeters in the midpoint between the center of gravity and the rear tip, and the thickness has to be at least 12 millimeters at a distance of 15 centimeters from the rear tip of the javelin.

OBJECT OF THE INVENTION

Within these limitations, the object of the invention is to provide an improved sports javelin that is not contrary to the recited rule requirements, but with better flight characteristics so that, according to the ability of the competitor, increased flight distances can be achieved and, moreover, so that the javelin will have a regular land.

SUMMARY OF THE INVENTION

I have discovered that, in contradiction to the general opinion up till now, there are certain types of flight and launching velocities where the unevenness of the javelin's surface does not have a disadvantageous effect on the flight characteristics and airworthiness of the javelin, but in fact has an explicitly positive influence. Practically the theoretical explanation of this phenomenon is as follows:

A javelin, like other bodies that are launched and travel through the air, has a well-defined theoretical trajectory that depends on a given velocity (the launching velocity) and a given launching angle, assuming there is no notice taken of other disturbing factors (e.g. wind).

The angle included by the longitudinal axis of javelin and the tangent of the trajectory described by the javelin's center of gravity is the so-called $\alpha$ angle of attack that is characteristic of the throw. The trajectory of the javelin can be divided into three sections: the ascending branch, the highest point and the descending branch. There is a point in the trajectory, namely the highest point, where the direction of the motion changes and the resultant force $F_r$ that takes effect on the javelin becomes less than the force of gravity $\alpha$. In the ascending branch the javelin navigates best if a dynamic balance of forces comes about under such circumstances that the longitudinal axis of javelin and the current tangent of the trajectory make a minimal angle, i.e. the instrument heads towards the direction of progression. On the highest point an inflexion occurs, and the situation can be regarded as optimum if the javelin continues to head for the direction of progression, i.e. assumes the direction of the relative wind all the time. By making the javelin's surface uneven, besides keeping the rules that concern the geometrical shape of the javelin, I can achieve an effect that can ensure the required dynamic balance of forces at the beginning of the trajectory because the resultant force $F_{rh}$ acting upon the rear of the javelin becomes smaller, therefore the total resultant force $F_r$ acts with a smaller moment M on the javelin and, as a consequence, the javelin does not begin to fall too early and it can continue traveling in the direction of progression. At the same time the purposely provided unevenness does not have a negative effect in the descending branch because the increase of the wind resistance is practically negligible relative to the speed decrease appearing in this section, and does not have an influence on the javelin's flight.

BRIEF DESCRIPTION OF THE DRAWING

The above and other objects, features and advantages of my invention will become more readily apparent from the following description, reference being made to the accompanying highly diagrammatic drawing in which:

FIGS. 1 and 2 are diagrams illustrating forces on a javelin in flight.

SPECIFIC DESCRIPTION

These phenomena can be explained best on the basis of the drift conditions appearing during the javelin's flight. Namely, the javelin's trajectory under given launching condition is affected mainly by the forces that have an origin of drift. As can be seen in FIG. 1, the resultant force $F_r$ of these drift forces, formed by wind resistance $F_w$ and the lift force $F_t$, is located at a distance K from the center of gravity S, which is a very important parameter because under given circumstances it determines the moment M that turns the javelin's axis into the direction of the tangent of the trajectory (i.e. the actual direction of javelin's progression) and reduces the $\alpha$ angle of attack. If this distance k and hence the moment M is large, the angle between the javelin's axis and the direction of relative wind P, i.e. the angle $\alpha$ of attack will be small and there will be only a small lift force affecting the javelin. This distance k can be increased by thickening the rear part behind the center of gravity S or by making the front part thinner in front of the center of gravity S. However, since this is not permitted by the rules, it is a theoretical possibility only.

If the resultant force $F_{rh}$ affecting the rear part is increased while the resultant force $F_{rv}$ affecting the part in front of the javelin's grip at the center of gravity remains unchanged, as is shown in FIG. 2, the resultant force $F_{r1}$ will increase and move backward into the position $F_{r2}$, therefore the moment M that tends to decrease the angle $\alpha$ of attack will increase. The modifications of rules introduced in men's javelin had just this aim, resulting in smaller obtainable flight distances.

In order to produce a new javelin that has similar characteristics to the old one's without breaking the rules, it is obvious that the resultant force $F_{rh}$ affecting the rear part of the javelin must be decreased. This could be done by decreasing the javelin's cross-section behind the center of gravity (by decreasing length and/or diameter), but this is not possible because of the strict regulations. Thus a real solution can be found only by decreasing the drag coefficient $C_D$ introduced to characterize the drift force affecting the javelin. This can be done by making the javelin's rear surface uneven. Namely: if a cylinder is set into an air current, its drag coefficient $C_D$ decreases significantly in a critical range of the Reynolds number that characterizes the unevenness of the surface. The Reynolds number itself is a function of the velocity, i.e. the launching velocity by its definition ($R_e = vxd/\gamma$ where V is relative velocity; d is diameter, in the given case the diameter of the javelin's shaft; $\gamma$ is viscosity). Thus, making a surface roughness according to a certain launching velocity of the javelin in such a way that the result is the critical range of Reynolds number in which the drag coefficient decreases significantly, the javelin's flight characteristics can be influenced positively, i.e. by setting the javelin's optimal flying balance under given velocity circumstances, a trajectory can be achieved that, from the flight's point of view, results in the most favorable angle $\alpha$ of attack and, eventually, the longest possible flight distance.

As the required critical range of Reynolds number can be determined as a function of velocity and unevenness, there is a chance to put these relations into the practice.

The invention thus provides a javelin whose body has a conventional design, and which is at least partly provided with homogeneous uneven areas formed by points and intervening low areas whose height or depth is between 0.1 and 0.5 millimeters and whose density is at least 30 points per $cm^2$. According to the invention, it is particularly advantageous if the density of the uneven areas is between 50 and 120 points/$cm^2$.

The optimum degree of the roughness is a function of the competitor's capacity or the maximum launching velocity that can be achieved by him, namely in the relation that the greater the expected launching velocity, the less the optimum degree of roughness.

For men's javelin, assuming a flight distance of between 60 and 90 meters, the launching velocity has to be between 20 and 35 m/s. The height (or depth) of the unevenness required by this velocity is between 0.1 and 0.3 millimeters depending on the given velocity. E.g. a launching velocity of 32 m/s corresponds to an unevenness of between 0.15–0.2 millimeters assuming an optimum trajectory. For women's javelin the launching velocity is about 18–30 m/s assuming flight distances of 45–80 meters. A roughness of 0.2–0.3 millimeters can be regarded as an optimum in this range.

Regarding the critical range of Reynolds number, the roughening of the javelin can influence the flight characteristics in a positive way basically only in the 17–35 m/s range of launching velocity. This influence differs slightly in the case of men's and women's javelin. Men's javelin that has a disadvantageous flight posture and an early headlong fall because of the presently valid regulations, can be influenced positively mainly by full (or partial) application of uneven areas on the surface in a length of 180 centimeters behind the javelin's grip, when the aim is to increase the flight distance by reducing the drag coefficient behind the javelin's grip in the ascending branch. On the other hand, women's javelin has good airworthiness, and its trajectory resembles a very prolate ellipse. Such a javelin flies virtually almost parallel with the ground and has a very flat landing angle. This javelin can be influenced in two ways. One possibility is that in order to increase the normality of the throw, i.e. in order to achieve a tip-first landing, a strong uneven surface is applied over the last 40–7 centimeters of the javelin's shaft behind the grip (the roughness may vary from 0.2 to 0.5 millimeters in height and from 60 to 120 points/$cm^2$ depending on the velocity), and the javelin begins to fall headlong in the descending branch because of the provided uneven surface and leaves a well-defined trace n the ground.

The other solution that may increase the flight distance of the javelin starts from the fact that the javelin has a good airworthiness and behavior in the air and it is in a dynamic balance. That solution assumes that the drag coefficient acting on the javelin is relatively small but the javelin's flight characteristics can be further improved if such a roughness is provided on the whole surface of the javelin's shaft in the period of flight over a speed of 17 meters per second that is in accordance with the javelin's expected flight distance, i.e. reduces the drag coefficient.

The roughening of the invented javelin's surface can be carried out by several known methods.

If the roughing is made by painting, first the aluminum body of the javelin is finished and degreased by burnishing, then it is sprayed with the first coating that has a base of synthetic resin, then after drying the first coat is colored by spraying a similar resin-based paint that contains granulated filling material whose size and amount is in accordance with the desired roughness, e.g. a mixture of mica powder and metal powder in the ratio of 40–60 percent.

Additional roughness of the javelin's surface can be achieved by a Resacryl Super enamel based polymeric gel resin that contains Ongrovil grains. The grains are mixed in the paint in the ratio of 1–5 percent, depending on the desired roughness. By increasing the percentage, the number of gains per square centimeter can be increased proportionally. In this way, a mixture of 1 percent results in about 32 points/cm$^2$, while a mixture of 5 percent causes a surface roughness of 120 points/cm$^2$. It does not seem advisable to increase the density of grains above a mixture rate of 5 percent in part because of the desired results and in part because of the fact that the use of a spraying gun is impossible at such a ratio.

Another possible procedure for creating surface unevenness on a javelin is a kind of surface roughening as results in rasper manufacturing. In this case the existing machine has to be converted in such a way that it should be suitable for machining one of the two ends of the javelin reckoning from the grip continuously, without any correction. The quality of the roughness can be described as in the case of raspers, namely by the number of teeth in 1 centimeter of the breaking tool. The closeness of teeth on the surface is inversely proportional to the depth of the cut. In order to improve the aerodynamic features of men's and women's javelin, a cutting of 12–35 teeth is suitable to a depth of 0.1–0.5 millimeters. The roughening can be done parallel with the axis of javelin, parallel and transversally at the same time, angularly around the longitudinal axis, in a spiral line in one direction, in a double spiral where the first direction is perpendicular to the second one, and perpendicularly to the axis of the javelin.

There is an additional possibility to make uneven areas on the surface of the javelin by an electrolytical procedure where instead of painting, a thin metal film is applied on the javelin's surface electrolytically.

In certain cases roughing can be done in a negative direction as well, e.g. by squeezing, a perforation etc.

However, all the procedures have such results that can be considered within the scope of the invention in so far as the aim is to achieve a proposed quality of surface by processing the javelin's shaft.

The roughness according to the invention is suitable to influence positively the flight characteristics, mainly the flight distance of a javelin that has a flight velocity of 17–35 meters per second, which results in both an increased flight distance and a regular, tip-first landing.

I claim:

1. A javelin for men's javelin competition, comprising an elongated body having points at opposite ends and a grip and conforming to men's javelin competition regulations, said body having a roughened outer surface over a length of the body extending substantially 180 cm rearwardly of said grip, said roughened outer surface having an array of points with a density of said points of at least 30 points/cm$^2$ and a height of the points of substantially 0.1 to 0.5 mm.

2. The javelin for men's javelin competition defined in claim 1 wherein said roughened outer surface has a density of said points between 50 and 120 points/cm$^2$.

3. The javelin for men's javelin competition defined in claim 2 wherein said roughened outer surface extends parallel to an axis of the javelin.

4. The javelin for men's javelin competition defined in claim 2 wherein said roughened outer surface extends parallel to an axis of the javelin and transversely thereto.

5. The javelin for men's javelin competition defined in claim 2 wherein said roughened outer surface extends spirally around said body.

6. A javelin for women's javelin competition, comprising an elongated body having points at opposite ends and a grip and conforming to women's javelin competition regulations, said body having a roughened outer surface over a length of the body extending over substantially a last 40 to 70 cm of said body rearwardly of said grip, said roughened outer surface having an array of points with a density of said points of at least 30 points/cm$^2$ and a height of the points of substantially 0.1 to 0.5 mm.

7. The javelin for women's javelin competition defined in claim 6 wherein said roughened outer surface has a density of said points between 50 and 120 points/cm$^2$.

8. The javelin for women's javelin competition defined in claim 7 wherein said roughened outer surface extends parallel to an axis of the javelin.

9. The javelin for women's javelin competition defined in claim 7 wherein said roughened outer surface extends parallel to an axis of the javelin and transversely thereto.

10. The javelin for women's javelin competition defined in claim 7 wherein said roughened outer surface extends spirally around said body.

11. A javelin for women's javelin competition, comprising an elongated body having points at opposite ends and a grip and conforming to women's javelin competition regulations, said body having a roughened outer surface over the entire length of the body, said roughened outer surface having an array of points with a density of said points of at least 30 points/cm$^2$ and a height of the points of substantially 0.1 to 0.5 mm.

12. The javelin for women's javelin competition defined in claim 11 wherein said roughened outer surface has a density of said points between 50 and 120 points/cm$^2$.

13. The javelin for women's javelin competition defined in claim 12 wherein said roughened outer surface extends parallel to an axis of the javelin.

14. The javelin for women's javelin competition defined in claim 12 wherein said roughened outer surface extends parallel to an axis of the javelin and transversely thereto.

15. The javelin for women's javelin competition defined in claim 12 wherein said roughened outer surface extends spirally around said body.

16. A method of increasing flight distance of a javelin for javelin competition, comprising the steps of:

(a) providing an elongated javelin body having points at opposite ends and a grip and conforming to javelin competition regulations; and (b) providing said body with a roughened outer surface over at least a portion of the length of the body, said roughened outer surface having an array of points with a density of said points of at least 30 points/cm$^2$ and a height of the points of substantially 0.1 to 0.5 mm.

* * * * *